United States Patent [19]

Hashimoto et al.

[11] 4,138,755

[45] Feb. 13, 1979

[54] POLISHING APPARATUS FOR ELECTROLYSIS MOTHER PLATE

[75] Inventors: Shigetoshi Hashimoto, Ageo; Keisuke Nishiyama, Shimonoseki, both of Japan

[73] Assignee: Mitsui Mining & Smelting Co., Ltd., Nihonbashi-Maromachi, Japan

[21] Appl. No.: 811,151

[22] Filed: Jun. 29, 1977

[30] Foreign Application Priority Data

Jan. 13, 1977 [JP] Japan ..... 52-2791

[51] Int. Cl.[2] ..... B08B 13/02

[52] U.S. Cl. ..... 15/77; 51/80 R

[58] Field of Search ..... 15/77, 102; 51/23, 80 R

[56] References Cited

U.S. PATENT DOCUMENTS

| | | | |
|---|---|---|---|
| 2,220,982 | 11/1940 | Toney | 15/77 |
| 3,501,795 | 3/1970 | Jasberg | 15/77 |

*Primary Examiner*—Edward L. Roberts

[57] ABSTRACT

An apparatus is described for automatically polishing cathode mother plates stripped of electrolytically deposited metal in an electrolytic metal recovery system, comprising a lift means to lift the mother plates from a conveyor carrying vertically disposed mother plates having been stripped of deposited metal, and two polishing means, each disposed adjacent to the lift means for polishing respective surfaces of the mother plates, whereby the mother plates are polished in a short period comparable to that required for conventional stripping operations, the polishing apparatus being incorporated in the stripping system.

3 Claims, 9 Drawing Figures

POLISHING APPARATUS FOR ELECTROLYSIS MOTHER PLATE

BACKGROUND OF THE INVENTION

The present invention relates to an apparatus for automatically polishing mother plates used in the electrolytic recovery of nonferrous metals such as zinc, copper or lead. The apparatus is disposed in a stripping device wherein the deposited metal formed on the mother plates during an electrolysis operation is removed therefrom, and the plates reconditioned so that the mother plates can be transferred back to the electrolytic cells for cyclic use.

Nonferrous metals, such as zinc, copper or lead, are normally refined by electrolytic processes, wherein the desired metal in the ore is leached in the form of an aqueous metallic salt solution which is subsequently electrolized to obtain the metal electro-deposited on cathode plates. In the electro winning of zinc, for instance, a lead plate containing silver is used as the anode and a 99.9% pure aluminum plate as the cathode; an acidic solution of zinc sulphate is electrolyzed for about 24 hours in a cell to produce a deposit of metallic zinc having a desired thickness on the cathode plate, i.e. the mother plate. High purity zinc metal is obtained by stripping the thus deposited zinc metal plate (hereinafter called metal plate) from the cathode mother plates removed from the cell.

In the hydro-metallurgical refining of copper, on the other hand, stainless steel or titanium is used as the mother plate material. In the electro winning of nonferrous metals such as zinc or copper, the aqueous salt solution of the desired metal is first electrolyzed by arranging a plurality of cathode and anode plates alternatively within the cells, and a number of the cathode plates are removed from the cells when the desired metal is deposited on the cathodes after a predetermined period of electrolysis; and the removed cathode metal plates are subsequently transferred by a crane or hoist to the stripping system to remove the deposited metal. The metal plates removed from the cells are stripped of the desired metallic deposits as they are individually carried by a conveyor through the stripping system, and subsequently carried back to the electrolytic cells by a crane or hoist, after a predetermined number of mother plates have accumulated.

The cathode plates, for example, aluminum plates continuously recycled in the electrolysis of zinc, are gradually corroded by the sulfuric acid or traces of florine contained in the electrolyte, resulting in pittings or irregularities on the surfaces thereof. Since such pittings or irregularities in the mother plates cause inhomogeneity of electro deposits, re-dissolution of the deposited metal, or too strong adhesion of the deposited metal on the plate surfaces, thereby inhibiting automatic stripping, it has been the practice to periodically polish manually the surfaces of the mother plates by whetstones or wire brushes before returning the plates to the electrolytic cells.

While stripping systems have recently been mechanized or automated, the periodic polishing of the plates is still currently accomplished by an elaborate method in which the mother plates are individually discharged from the stripping system, making the stripping very complicated. In contrast to conventional polishing in which the mother plates are periodically removed from the stripping process for polishing only upon the appearance of corrosion, the polishing step according to the present invention is mechanized and built into the stripping step permitting fully automated stripping wherein the mother plates, having been stripped of the metallic deposits, are immediately polished while in the stripping system.

SUMMARY OF THE INVENTION

An object of the present invention is to provide a polishing apparatus adapted to be built into a system in which electro-deposited metals formed during electrolysis are stripped from the cathode mother plates.

Another object of the present invention is to provide a polishing apparatus facilitating automatic polishing of a mother plate in a short period of time comparable to that required for stripping.

A further object of the present invention is to provide an apparatus adapted to polish mother plates during each successive stripping operation and also adapted to polish the mother plates after they are cycled a predetermined number of times thorugh the process.

BRIEF DESCRIPTION OF THE ACCOMPANYING DRAWINGS

DETAILED DESCRIPTION OF THE INVENTION

Figure 1:
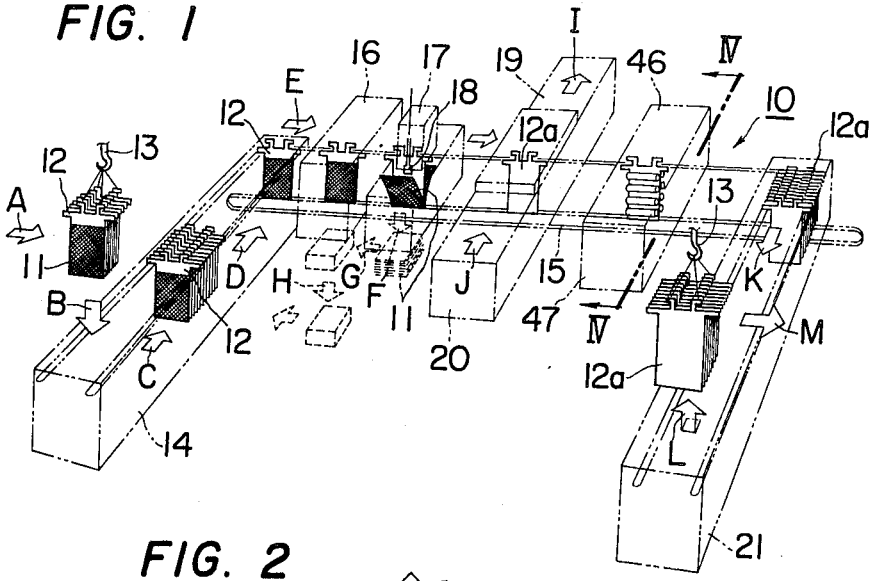
FIG. 1 is a perspective view of a system for stripping zinc from cathode mother plates in the electro winning of zinc.

A system for the electro winning of zinc is now described by way of example, making reference to the accompanying drawings. A polishing device 10 is built in the stripping system as illustrated in FIG. 1. A set of mother plates 12, with zinc 11 electro-deposited on the surfaces thereof, are removed by a crane 13 from the cells (not shown) to a feeding conveyor 14 as indicated by arrows A, B and C. A plurality of the metal plates 12 are then transferred from the feeding conveyor 14 to another conveyor 15 as indicated by the arrow D. The metal plates 12, being carried by the conveyor 15 (arrow E), are hammered at the top by a hammering device 16 to promote the separation of the zinc deposits 11 from the metal plates 12, by making a slight gap at the top portion of the deposits. After being carried through the hammering device 16, the metal plates are placed in the stripping device 17 wherein the deposits are stripped by inserting a wedge 18 between the deposited zinc 11 and the mother plates 12. The deposited zinc sheets 11 are then dropped under the stripping device 17 as indicated by the arrow F and, after a predetermined number of sheets are piled up, they are transferred to a casting plant as indicated by the arrows G and H.

Although the most of the plates 12 are normally stripped at the stripping device 17 and carried directly to the polishing device 10, it sometimes occurs that some metal plates fail to be stripped at the stripping device 17. The unstripped metal plates 12 still carrying the deposits on the surfaces thereof are discharged from the unstripped-plate discharging device 19 as indicated by the arrow 1. A new mother plate 12a carrying no deposits on the surface is then carried onto the conveyor 15 by the injection device 20 as indicated by arrow J. The mother plates 12a either stripped at the stripping device 17 or newly injected from the injection device 20 are, according to the present invention, transferred to the polishing device 10 where both surfaces of the mother plate 12a are polished. The mother plates are then transferred to the discharging device 21 where a predetermined number of the plates are lined up to be discharged by a hoist 13 (arrow L) and subsequently carried to the electrolytic cells (arrow M).

Figure 2:
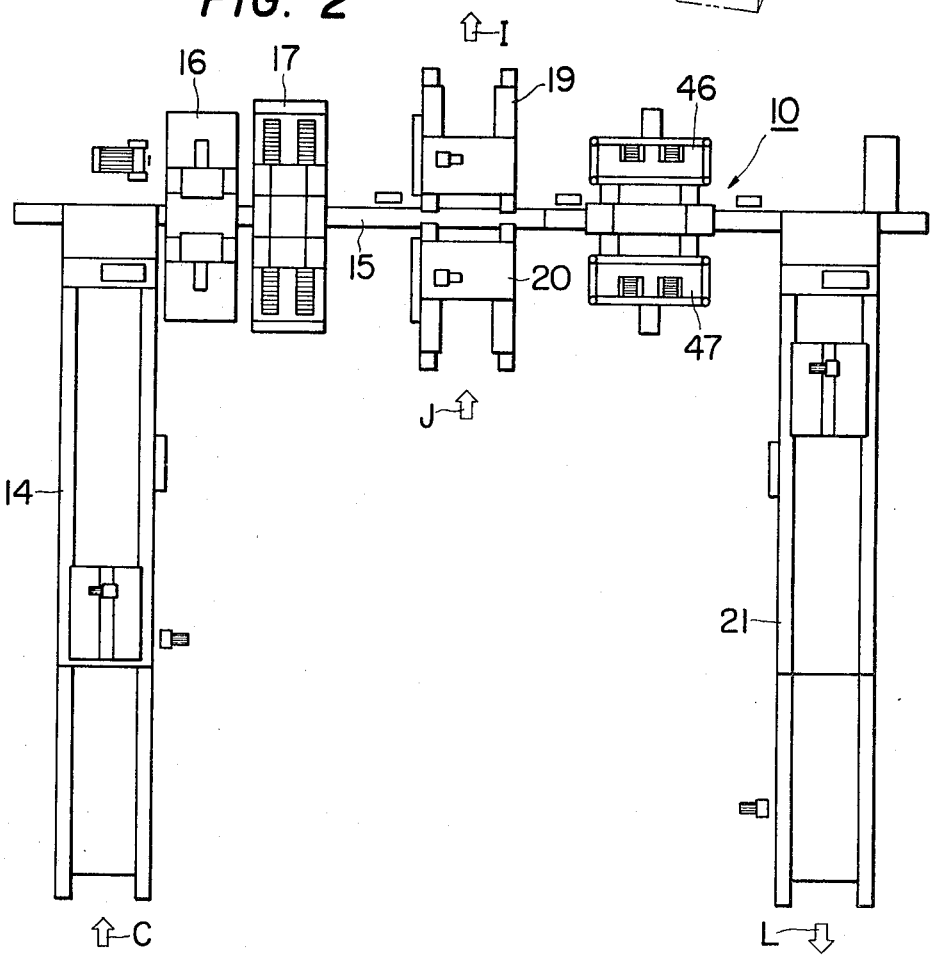
FIG. 2 is a plan view of the system shown in FIG. 1.

The polishing device according to the invention is installed in the stripping system as illustrated in FIGS. 1 and 2. The construction of the polishing device will now be described in reference to FIGS. 4 to 9. A frame 22 comprising four support posts 23 and four beams 24 is disposed over the conveyor 15 carrying the mother plates 12a. A stopper mechanism 25 to stop the movement of mother plates 12a as they are transferred to the polishing device is provided on the frame 22. As is seen from FIG. 5, the stopper mechanism 25 comprises a stopper cylinder 27 disposed on the stopper support 26 secured to the support post 23, the rod 28 of the cylinder 27 being connected to a stopper shaft 31 guided by the stopper guide 30, the stopper shaft 31 having a stopper plate 29 as the free end thereof to stop the movement of the mother plates 12a.

A lifting frame 35 is disposed on a rod 34 of a cylinder 33 provided on the plate 32 fastened to the beam 24 so that the vertical motion of the frame 35 is actuated by the cylinder 33, whereby the plates 12a are lifted from the conveyor for polishing operations. Guides 36, are provided on the plate 32 to support rods 37 connected to the frame 35, whereby swinging motion of the frame 35 is prevented when the rods 37, being actuated by the cylinder 33, slide inside the guides 36.

Figure 9:
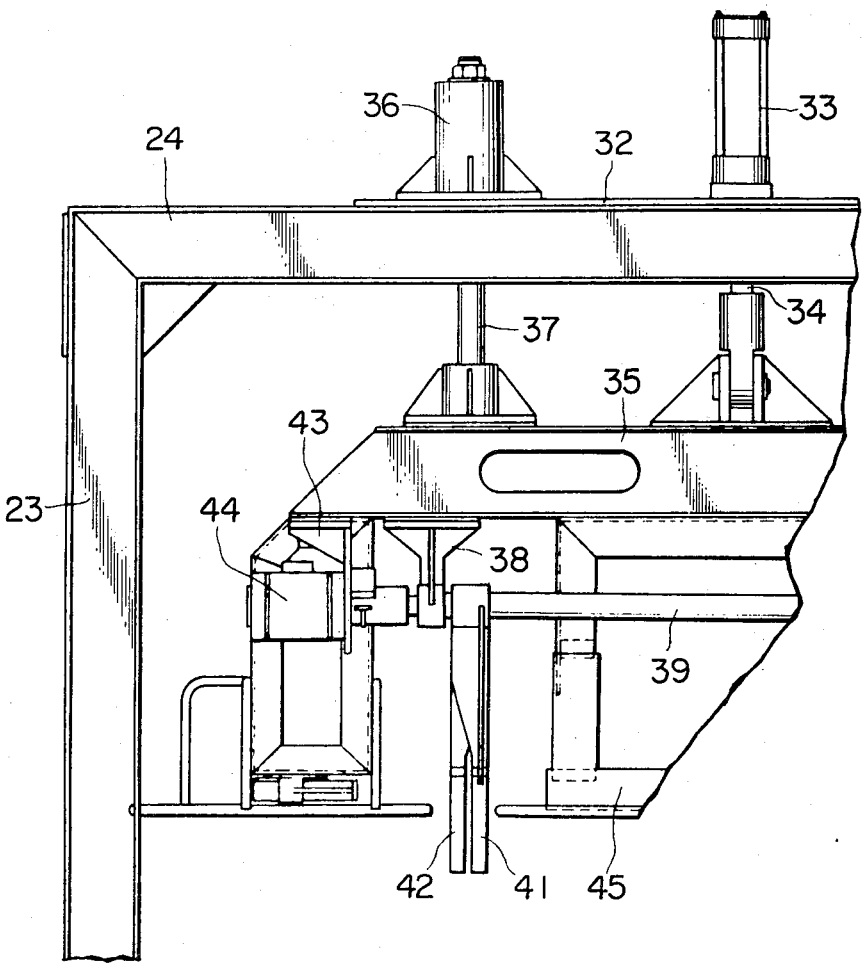
FIG. 9 is a partially enlarged view taken on the lines IX—IX of FIG. 8.

As seen from FIG. 9, two clamp shafts 39 and 40, received by a bearing 38 secured to the lifting frame 35, are provided with clamp arms 41 and 42 for gripping the mother plates 12a. The gripping action whereof is driven by an oscillating motor 44 mounted on the bracket 43 secured to the lifting frame 35 having a plate guide 45 for guiding the top portion of the mother plates 12a.

Figure 7:
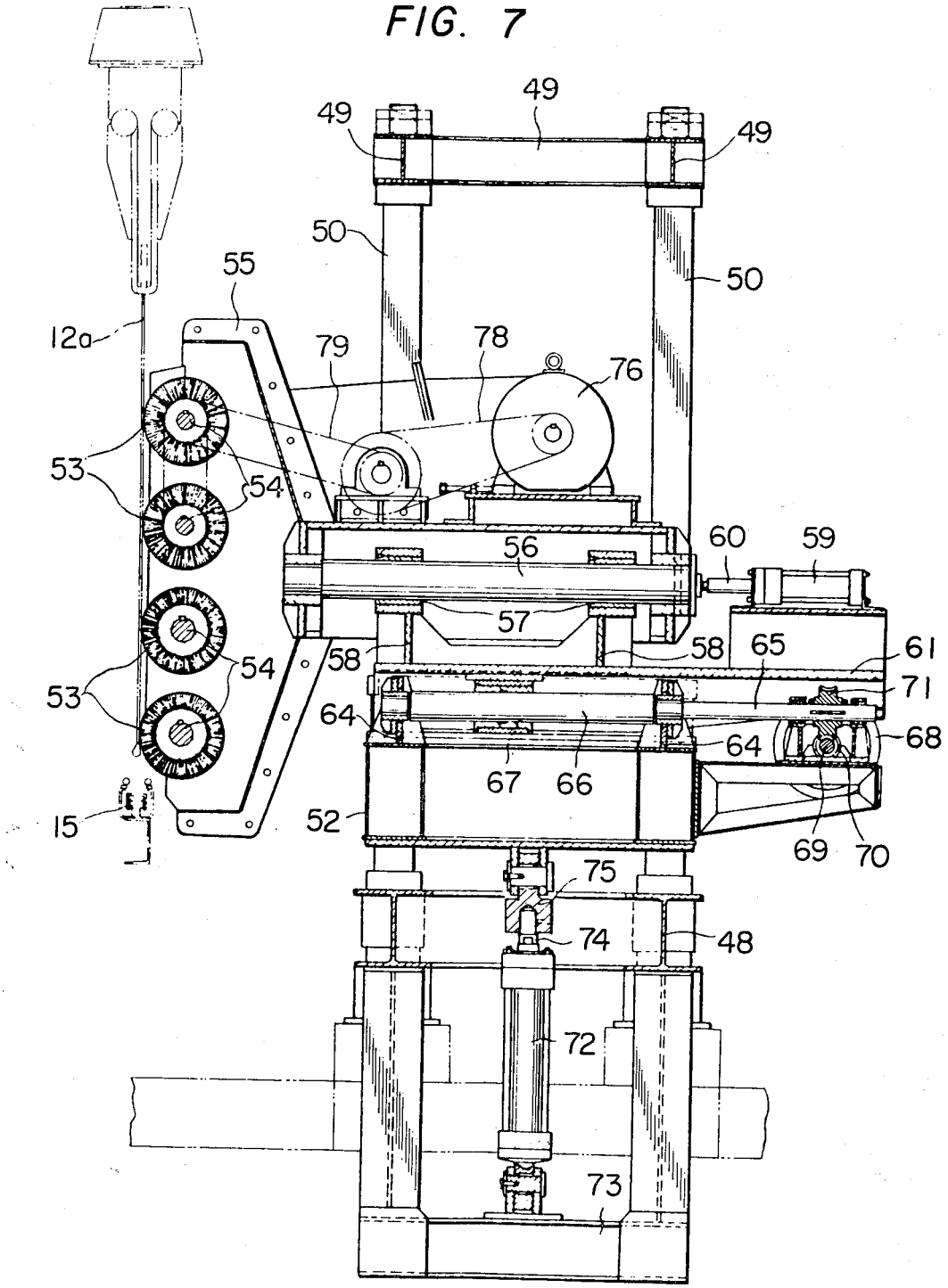
FIG. 7 is a sectional view taken on the lines VII—VII of FIG. 6.
Figure 8:
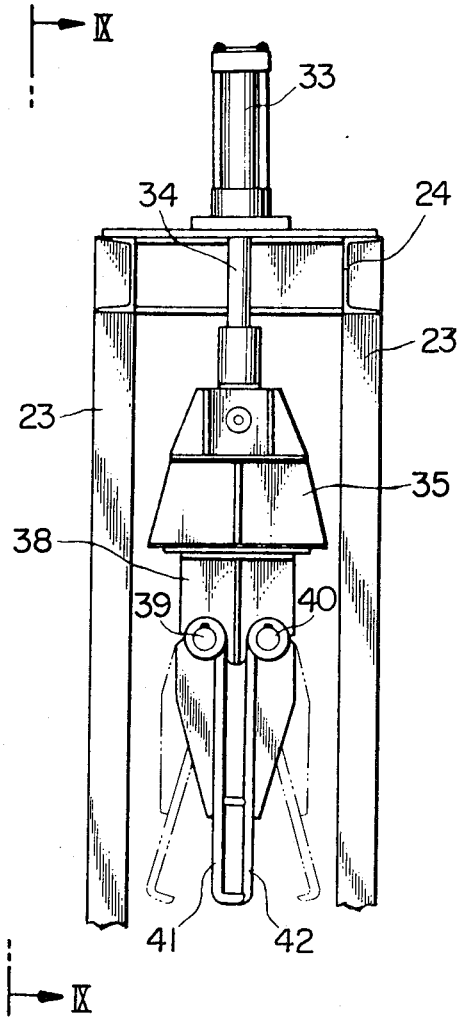
FIG. 8 is a partially enlarged view of FIG. 4.

Two identical polishing sections 46 and 47, only one of which is shown in FIG. 7 for simplicity, are provided at both sides of the frame 22. A lifting frame 52 is fastened to sleeves 51 slidably mounted on four guide shafts 50 mounted on a base 48 at the bottom and on the beam 49 at the top. A press head 55, carrying four cylindrical wire brushes on support shafts 54 is mounted to a guide shaft 56 which is supported by a bearing 58 having brushes to receive the shaft 56. The guide shaft 56 is connected to a rod 60 to be actuated by a press cylinder 59, causing a horizontal motion of the wire brush 53 towards the mother plates 12a.

Figure 5:
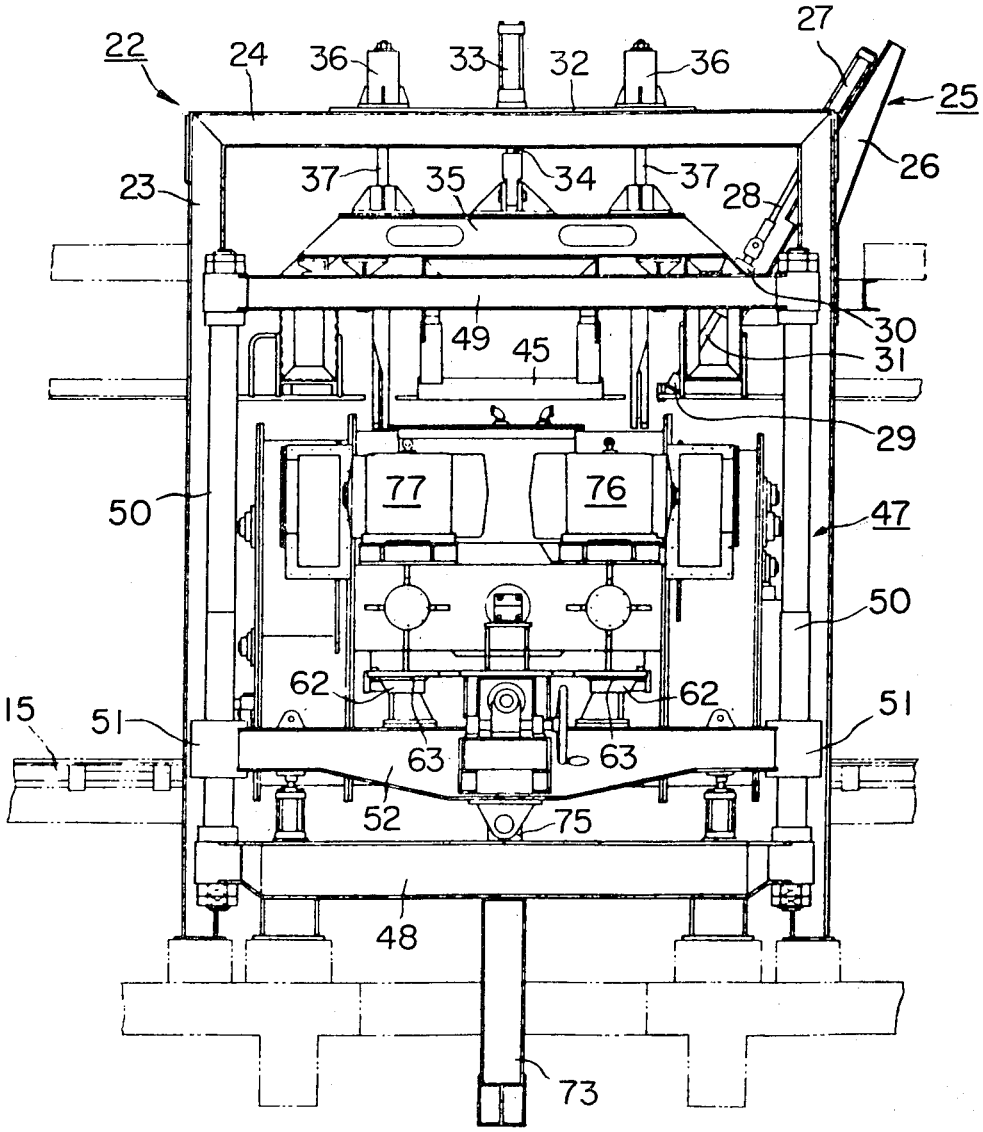
FIG. 5 is a side elevational view taken on the lines V—V of FIG. 4.
Figure 6:
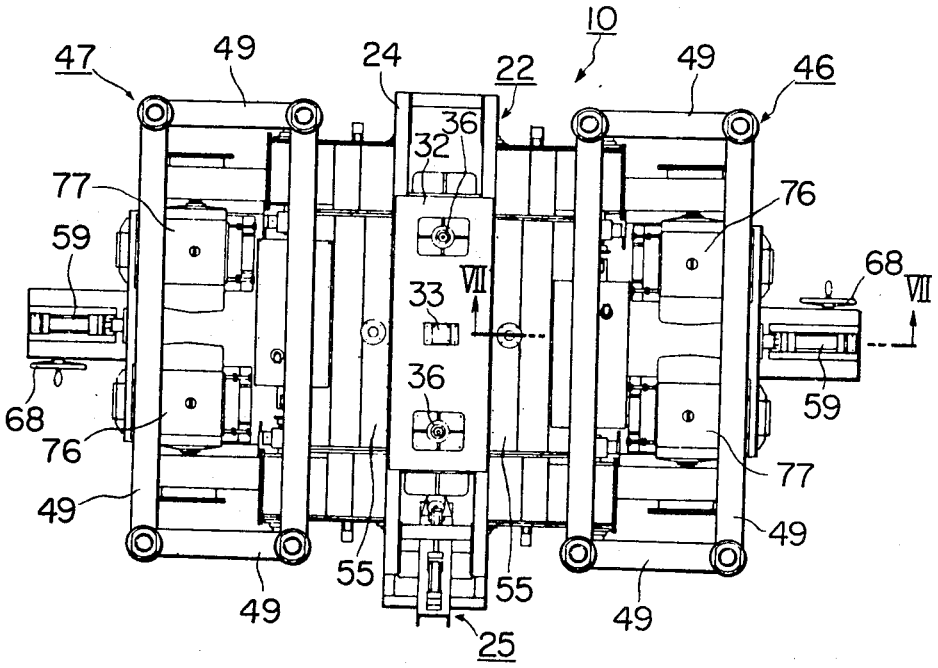
FIG. 6 is a plan view of FIG. 5.

As illustrated in FIG. 5, the bearings 58 and the press cylinder 59 are carried by a base 61 slidably mounted on the support plates 63 which in turn is fastened to a lifting frame 52, whereby the base 61 is movable up to or away from the mother plates 12a in order to shift the extent of the reciprocal motion of the press head 55. The horizontal shift of the slidable base 61 is caused by the operation of a handle 68, the rotation whereof being transmitted through a worm gear 70 mounted on a shaft 69, and a worm wheel 71 secured to a slide shaft 65 supported by bearings 64 on the lifting frame 52, resulting in rotation of a screw 66 formed on the slide shaft 65 and engaging a nut 67 secured to the base 61 to cause the axial motion of base 61 to permit the positional adjustment of the base 61.

A cylinder support 73 secured to the base 48 is provided with a brush lifting cylinder 72. A rod 74 secured to the lifting frame 52 through a joint 75, so that the wire brushes 53 are vertically displaced by the vertical movement of lifting frame 52, is actuated by a cylinder 72.

As is seen from the drawings, four wire brushes 53 are driven by two motors 76, and 77, rotation of one motor 76 being transmitted through chains 78 and 79 to two bearing shafts 54, and the rotation of the other motor 77 being transmitted in the same manner to the other two shafts.

The polishing section 46 balances itself by locating the two motors 76 and 77 at positions symmetrically spaced from the central axes of the section. Both sides of the mother plates 12a are sumultaneously polished by disposing two identical polishing sections at opposed sides of the conveyor 15.

The mother plats 12a, stripped of the deposited zinc 11 at the stripping device 17, are transferred to the polishing device 10 by the conveyor 15, and stopped by the stopper plate 29 which has been brought to the extended position by the cylinder 27. The clamp arms 41 and 42 are subsequently driven by oscillating motor 44 to grip the top portion of the mother plates 12a in order to lift the same by the frame 35 actuated by the cylinder 33 as illustrated in FIG. 7. The wire brushes 53 are then pressed in contact with the mother plates 12a by the press cylinder 59, and lowered by the brush lifting cylinder 72 to engage the surface of the plates 12a at the position shown in FIG. 7. Water is directed to surfaces of the mother plates 12a from nozzles (not shown) during the polishing so as to prevent the formation of dust and wash the surfaces of the mother plates 12a.

Figure 3:
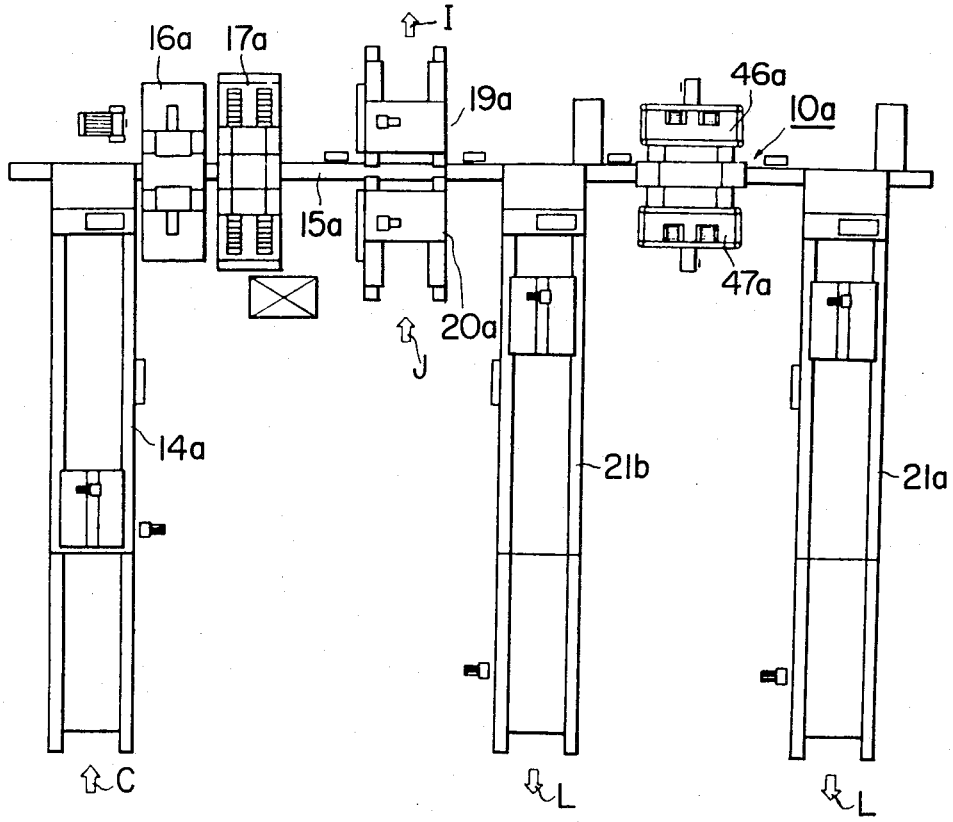
FIG. 3 is a plan view of another stripping system for the electro winning of zinc.
Figure 4:
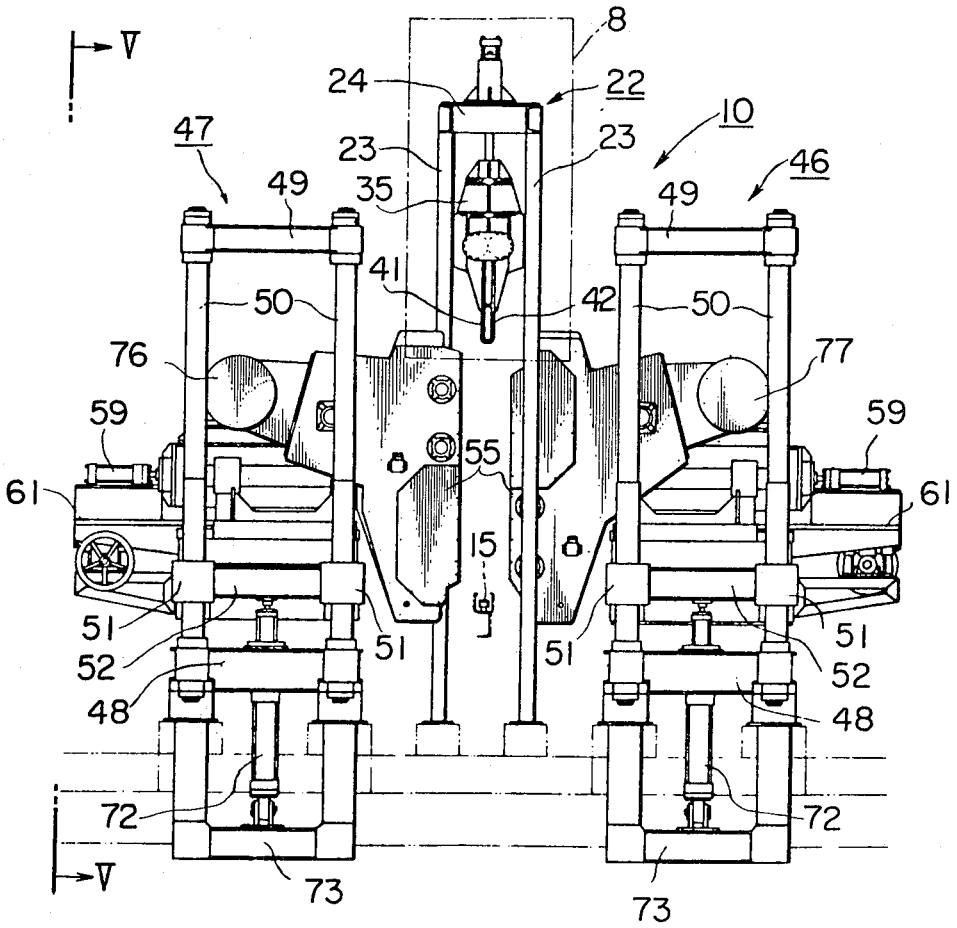
FIG. 4 is a front elevational view of a polishing apparatus according to the present invention taken on the lines IV—IV of FIG. 1.

Although the foregoing description relates particularly to the polishing device shown in FIGS. 4 to 9 as disposed in the stripping system shown in FIGS. 1 and 2, the same polishing device may also be disposed in a stripping system shown in FIG. 3, wherein the members corresponding to those already described are referred to by the same numbers. The stripping device shown in FIG. 3 is provided with two removal devices 21a and 21b, the mother plates to be sent directly back to the electrolytic cells without polishing being discharged through device 21b, and the only plates to be polished being transferred to the polishing device 10a.

Although the present polishing apparatus is preferably installed inside the stripping device, the same apparatus may also be used as a single unit for polishing plate-like articles. Although the metal plates are polished by means of downward movement of the head as previously described, it is possible to polish them by means of moving the same vertically while the press head is stopped.

According to the present invention, the stripping system, including the polishing step, can be fully automated. This is because the mother plates are polished each time the electrolytic deposits are stripped while at the same time they are vertically supported on the conveyer without being discharged from the apparatus.

What is claimed is:

1. An apparatus for removing corrosion from cathode mother plates stripped of metallic electrodeposits in a stripping system comprising a conveyor for carrying the metal plates stripped of said deposits, lift means above said conveyor adapted to grip and lift said plates vertically above said conveyor, two polishing sections disposed adjacent to and at both sides of the said lift means, each including a head provided with cylindrical wire brushes on a plurality of horizontal shafts to polish the mother plates, and horizontal and vertical means disposed on each said polishing sections to direct the respective heads horizontally and vertically in communication with the mother plates respectively.

2. An apparatus according to claim 1, wherein said lift means comprises a frame disposed above said conveyor, a lift actuated by a hydraulic cylinder disposed on the top of said frame, a clamp mounted on the lift to grip said mother plates, and a stop means mounted on said frame to stop the motion of the mother plates when it is moved in a vertically supported condition to the position where it is gripped by said clamp.

3. An apparatus according to claim 1, wherein said respective polishing sections comprise four support posts, said horizontal and vertical means including a vertically slidable lift means mounted on said posts, a slidable base supporting a hydraulic cylinder connected to and movable towards said head and being mounted on said lift means so as to be horizontally slidable up to or away from said mother plates, means to move said slidable base towards the mother plates in order to shift the extent of the reciprocal motion of said head being actuated by said hydraulic cylinder, and a hydraulic cylinder to actuate the vertical reciprocal motion of said lift means.

* * * * *